United States Patent [19]

Dominguez et al.

[11] 4,408,570

[45] Oct. 11, 1983

[54] TUBE HANGER FOR STEAM GENERATOR

[75] Inventors: Manuel F. Dominguez; Joseph E. Ferguson, both of Bakersfield, Calif.

[73] Assignee: Shell Oil Company, Houston, Tex.

[21] Appl. No.: 382,339

[22] Filed: May 26, 1982

[51] Int. Cl.[3] ..... B22B 37/24; F28F 9/02

[52] U.S. Cl. ..... 122/510; 122/512; 165/162; 165/172

[58] Field of Search ..... 122/510, 512; 165/76, 165/82, 162, 172

[56] References Cited

U.S. PATENT DOCUMENTS

| | | | |
|---|---|---|---|
| 4,030,540 | 6/1977 | Roma | 122/510 |
| 4,080,998 | 3/1978 | Mottola et al. | 122/510 |
| 4,100,889 | 7/1978 | Chayes | 122/510 |
| 4,184,862 | 1/1980 | Waters | 165/162 |
| 4,231,421 | 11/1980 | Eaton et al. | 165/172 |
| 4,241,518 | 12/1980 | Alexy | 165/89 |
| 4,307,777 | 12/1981 | Chwyla | 122/510 |
| 4,337,827 | 7/1982 | Jabsen | 122/510 |
| 4,338,887 | 7/1982 | Leon | 122/4 D |

*Primary Examiner*—Henry C. Yuen

[57] ABSTRACT

A tube hanger for use in radiant steam generators of the type where the tubes form a cylindrical wall surrounding a centrally located burner. The hanger is of a split design that allows removal of the tubes without removing the hanger from the generator shell.

3 Claims, 3 Drawing Figures

FIG. 1
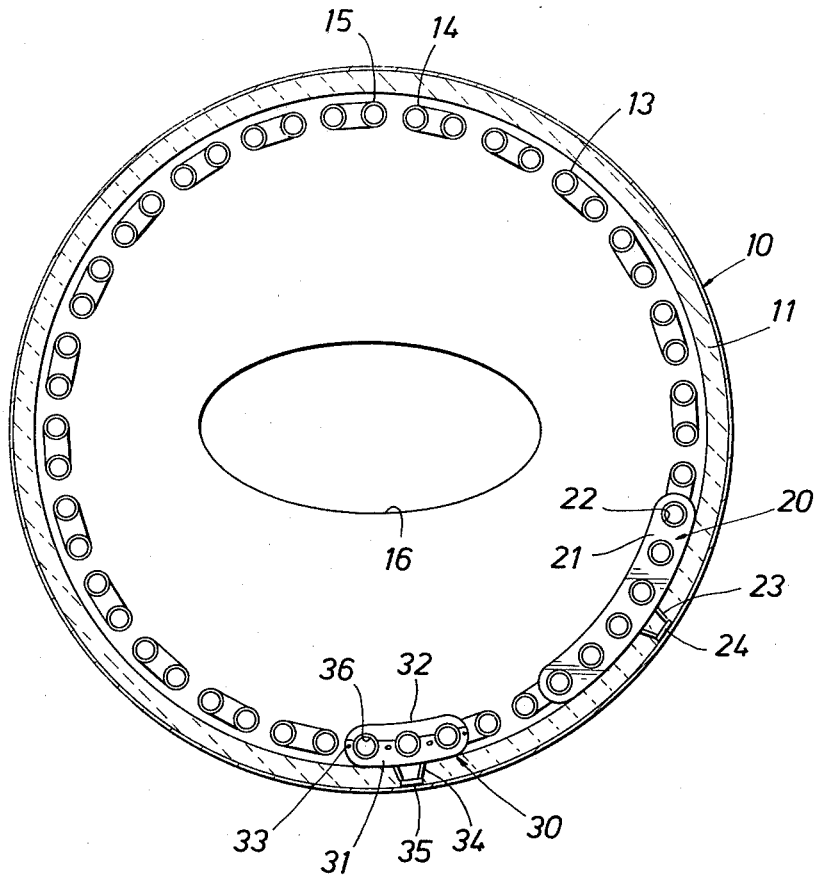
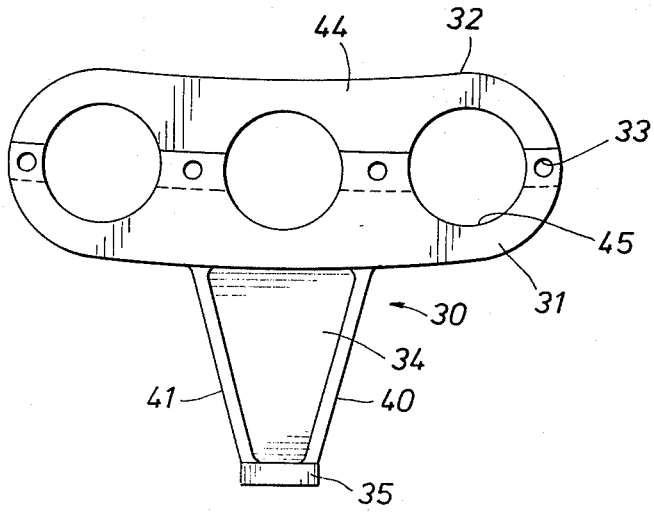
FIG. 2
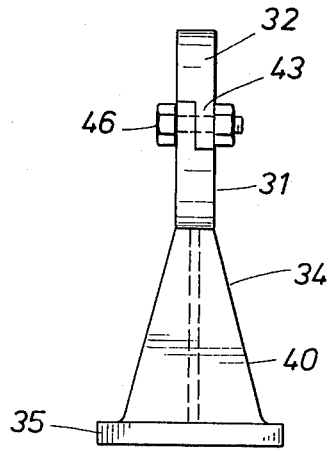
FIG. 3

TUBE HANGER FOR STEAM GENERATOR

BACKGROUND OF THE INVENTION

The present invention relates to the thermal recovery of heavy crude oils and particularly to the steam generators used for supplying steam for thermal recovery projects. The conventional steam generator used in a thermal recovery project comprises a radiant section followed by a convection section which joins with the stack for the exhaust gases. The radiant section consists of a cylindrical furnace having an outer shell lined with a plurality of boiler tubes. The furnace burner is placed at one end of the cylindrical furnace and the combustion products flow through the radiant section into the convection section of the steam generator and out the stack. The boiler tubes lining the radiant section are arranged in a once-through flow pattern wherein the water is introduced through one of the tubes, flows through all of the tubes and then exits from the tube adjacent the inlet.

In the above described generator the tubes of the radiant section are secured to the outer shell by means of tube hangers. These tube hangers comprise a yoke section which is provided with openings for supporting the tubes with the yoke section being attached to a supporting leg that is firmly anchored to the outer shell.

While the above tube hangers adequately support the tubes in the radiant section of the steam generator, they create unnecessary difficulties when it is necessary to replace a tube or a tube hanger. The inner surface of the yoke member of the tube hanger is exposed to the direct radiant heat of the furnace causing this portion of the hanger to fail. If a tube hanger fails, it is of course, necessary to remove all of the tubes in the tube hanger and the hanger itself in order to replace the hanger. The same problem occurs when it is necessary to remove and replace one of the tubes. It is normally impossible to slide the tubes out of the hanger from one end of the generator since the radiant heat tends to warp the tubes causing them to stick in the hangers. The removal of the hangers is a difficult job since they are normally welded to the outer shell of the steam generator.

SUMMARY OF THE INVENTION

The present invention solves the above problems by separating the yoke member of the tube hanger into two individual sections which are secured together by removable fastenings. Thus, by removing the inner or removable section of the yoke member, it is possible to remove individual tubes and replace them without removing the remainder of the hanger from the shell of the steam generator. Also, it is possible to remove the inner section of the yoke without removing the remainder of the tube hanger and replace it without disturbing the remainder of the hanger. This simplifies the repair and lowers the cost since only a small portion of the refractory will require removal.

BRIEF DESCRIPTION OF THE DRAWINGS

The present invention will be more easily understood from the following description when taken in conjunction with the attached drawings in which:

FIG. 1 is a cross section of the radiant section of a steam generator showing the tube hanger of the prior art and the tube hanger of the present invention installed therein.

FIG. 2 is an elevation view of the tube hanger of the present invention.

FIG. 3 is an end view of the tube hanger shown in FIG. 2.

DESCRIPTION OF A PREFERRED EMBODIMENT

Referring to FIG. 1, there is shown a vertical cross section of the radiant section of a conventional steam generator used in steam floods. As explained above, the radiant section is normally a long, horizontal cylindrical section whose outer shell or wall is lined with water tubes. The water tubes are disposed parallel with the axis of the cylinder in a once-through flow arrangement and receive water from the convection section that follows the radiant section. The convection section acts as a preheater for the feed water while the steam is generated in the radiant section. Traditionally, 40% of the heat transfer occurs in the convection section and 60% in the radiant section. This type of steam generator supplies steam at relatively high pressures; for example, 1500 to 2000 pounds per square inch of relatively low quality, for example 80% steam, and is normally fired with gas or fuel oil. The low quality steam is injected into wells to heat the low gravity crude oil so that it can be produced.

The cylindrical section of the steam generator comprises an outer wall or shell 10 and an insulating layer 11. The wall of the steam generator is lined with longitudinal tubes 13 which are arranged in a once-through flow pattern. For example, the water could be introduced through the tube 13, flow through all of the tubes and exit from the tube 15. The end of the radiant section is provided with an access opening 16 in which the burner element is normally positioned.

In the conventional steam generator, the tubes are supported and held in place in the radiant section by means of a tube hanger 20. The tube hanger includes a tube supporting section or yoke 21 which is provided with a series of openings 22 in which the tubes are positioned. The tube support section is connected or joined to a leg 23 which has sufficient length to extend through the insulating layer 11 and terminates adjacent the outer shell. The leg is provided with an anchoring member or flange 24 which is secured to the outer shell of the steam generator, usually by welding the anchor flange to the outer shell. The radiant section of the steam generator is completed by lining the outer shell with a thick layer of refractory material. In a conventional steam generator for thermal recovery units the outer shell is ⅜" thick, the refractory lining 5" thick with the tubes spaced 2" off the inner surface of the refractory. Obviously, these dimensions vary with different sizes of generators and different steam conditions.

As can be seen from the above description, to replace the tube hanger or any of the tubes supported by it, it is necessary to remove the tube hanger 20 and the six tubes supported by it from the radiant section of the steam generator so that the tube hangers can then be slipped off the end of the tubes and the tubes removed. This, of course, necessitates removing not only the tube hanger but the refractory material from the shell of the radiant section. As explained above, the tubes and the tube hangers are subjected or exposed to the direct radiant heat of the burner and tend to fail and must be replaced at times. Most thermal recovery projects utilize a large number of steam generators and the maintenance of the generator comprises a considerable portion of the overall expense of operation.

In order to solve the above problem the tube hanger of the present invention comprises a two-piece hanger as shown at 30. The hanger utilizes a partial tube support 31 which is coupled to the leg 34 having an anchoring flange 35 at its outer end. The tube support is completed by a removable yoke member 32 which is secured to the tube support and it, in cooperation with the partial tube support 31, provides a series of openings 36 for the tubes 13.

Referring to FIGS. 2 and 3, the construction details of the tube hanger of this invention are shown. In particular, the tube hanger 30 comprises the partial tube support 31 which is attached to the leg 34 that is provided with an anchoring flange 35 at its outer end. The leg 34 is formed with a central web that is stiffened by means of flanges 40 and 41. The removable yoke member 32 is attached to the partial tube support member 31 by means of removable fastenings such as bolts 46 which are positioned in the aligned holes 33 in the two members. The removable yoke 32 and partial tube support 31 are provided with a half lap joint 43 as shown in FIG. 3 and when assembled the curved cutout portions 44 and 45 of the yoke and tube support will form a circular opening for supporting the tubes in the steam generator.

From the above description it can be appreciated that the leg 34, including the partial tube support 31, can be permanently mounted in the wall of the radiant section of a steam generator. The anchoring flange 35 can be welded to the outer shell of the radiant section or fastened by other means, for example bolts and similar fastening means. Tubes can then be positioned in the hanger and the yoke member 32 installed and fastened in place by the removable bolts 46. The refractory material can then be placed on the shell of the radiant section in the same manner as is conventionally done. When it is necessary to remove or replace the tubes in the radiant section, the yoke member 32 can be removed and the tubes easily removed from the wall of the radiant section. Likewise, since only the yoke member 32 will be exposed to the direct radiant heat in the steam generator, only this member normally fails. This portion can be easily replaced and thus, only in rare circumstances will it be necessary to remove the tube support 31 and leg of member 32 and replace them.

What is claimed is:

1. A tube hanger for the longitudinal steam generating tubes in a cylindrical radiant steam generator comprising:

a leg member having an I-beam cross section, said leg member having sufficient length to extend through the cylindrical insulating wall of the steam generator, the outer end of said leg terminating in an anchoring flange disposed at right angles to the longitudinal axis of the leg;

a tube support member having a plurality of curved surfaces formed thereon, said curved surfaces conforming substantially to a portion of the outer diameter of the steam generating tubes of the steam generator, said tube support means being attached to the inner end of said leg;

a removable yoke member having a plurality of curved surfaces formed thereon, said curved surfaces conforming substantially to a portion of the outer diameter of the tubes of the steam generator, said removable yoke member being fastened to said tube support means with the curved surfaces on each being aligned so that said surfaces substantially surround the tubes of the steam generator.

2. The tube hanger of claim 1 wherein said leg and tube support means are formed as a unitary structure.

3. The hanger of claim 1 wherein said removable yoke member is secured to said tube support member by removable fastening means.

* * * * *